United States Patent [19]

Kochakis

[11] Patent Number: 4,566,296

[45] Date of Patent: Jan. 28, 1986

[54] PADLOCK SECURITY COVER

[76] Inventor: Donald G. Kochakis, 95 E. Prospect St., Chula Vista, Calif. 92011

[21] Appl. No.: 633,059

[22] Filed: Aug. 6, 1984

[51] Int. Cl.[4] ..... E05B 67/38

[52] U.S. Cl. ..... 70/56; 292/281

[58] Field of Search ..... 70/56, 54, 55; 292/104, 292/148, 205, 281

[56] References Cited

U.S. PATENT DOCUMENTS

| | | | |
|---|---|---|---|
| 3,858,923 | 1/1975 | Bunn | 292/281 |
| 4,031,719 | 6/1977 | Klingler | 70/56 |
| 4,322,102 | 3/1982 | Lindblom | 292/281 |

*Primary Examiner*—Robert L. Wolfe

*Attorney, Agent, or Firm*—Charmasson & Holz

[57] ABSTRACT

A security cover for a padlock securing a door lock or the like comprises a first part for mounting on the door or door frame and a second part hinged to the first part so as to be moveable into a closed position covering the lock and at least the shackle part of the padlock, to restrict burglars from cutting through the shackle with bolt cutters. The second part has a suitable eye member or device mounted on its inner face for co-operation with the door lock in its closed position so that it can be locked closed by the padlock at the same time as the door is locked. The security cover may itself form the hasp of a door lock or may be completely separate from the lock.

8 Claims, 6 Drawing Figures

PADLOCK SECURITY COVER

BACKGROUND OF THE INVENTION

The present invention relates to a security cover for a padlock locking a door, gate or the like to reduce the risk of burglars breaking into the padlock.

Padlocks are often used to secure the doors of trucks, garages, warehouses, and the like. Such padlocks are often broken into by burglars who either force them apart or simply cut through their shackles using bolt cutters. This can be done very quickly, and the goods inside a truck, for example, can quickly be stolen while the driver is away for a few minutes or his attention is elsewhere. Padlocks are also used to secure gates by locking adjacent ends of chains wrapped around bars of the gates or a gate and fence. The padlock in this case is also relatively open to tampering.

SUMMARY OF THE INVENTION

It is an object of the present invention to provide a security cover for a padlock which makes it more difficult for burglars to break into places secured by a padlock.

It is a further object of the invention to provide a padlock security cover which makes it difficult or impossible for a prospective burglar to cut through the padlock shackle with bolt cutters.

Padlocks are commonly used to secure the doors of vans, trucks, garages and the like, either securing a bolt in place by passing the padlock shackle through an eye engaging over the bolt, or passing the shackle through aligned eyes on a fixed member (e.g. a staple) and a hasp or bolt.

According to the present invention a security cover for a padlock locking a door, gate or the like comprises a first part for mounting flat relative to the door, frame or gate and a second part hinged to the first part so as to be pivotable into a position covering at least the shackle of the padlock. The cover leaves insufficient space for bolt cutters to be used to cut through the shackle. The second part has an eye projecting inwardly which, in one embodiment of the invention, is arranged to be aligned with an eye forming part of the door lock when in its covering position, so that the padlock shackle can be passed through the aligned eyes of the cover and door lock to secure the cover in place.

Thus a burglar can neither remove the security cover nor break into the door lock using bolt cutters, since the padlock shackle which secures both the cover and door lock is inaccessible. At the time both the cover and door lock can be easily released by a key for unlocking the padlock.

In one embodiment of the invention the security cover itself forms a security hasp for securing to a suitable eye mounted on the frame or door. In this case part of the cover is mounted flat on the door or frame, respectively, and the second part, when pivoted inwardly, covers the eye with the eye on the second part aligned so that a padlock shackle can be passed through both eyes.

In another embodiment the security cover is separate from the door locking hasp and staple. The first part of the cover is not rigidly mounted on the door or frame, but is adapted to be passed behind the hasp in a location straddling the staple so that it is held in place. The second part then pivots over the staple so that its eye is aligned with the door lock eye or eyes, and the padlock shackle is then passed through the aligned eyes to lock the door and lock the security cover in place at the same time.

Preferably, in each embodiment at least part of the body of the padlock hangs below the security cover so that the padlock can readily be opened with a key. At the same time the cover leaves insufficient space for bolt cutters to be used to cut through the padlock shackle.

In another embodiment the security cover is designed to secure and cover a chain and padlock for locking a gate. The first part of the cover may be located flat against the gate, and the first and secured parts have interengageable locking members which can be secured by a padlock when the second part is in its closed position. The opposite ends of a chain securing the gate are also engaged by the padlock.

The security cover may be made of any suitably strong material to resist tampering of cutting, such as heavy guage iron or steel.

DESCRIPTION OF THE PREFERRED EMBODIMENTS

Figure 1:
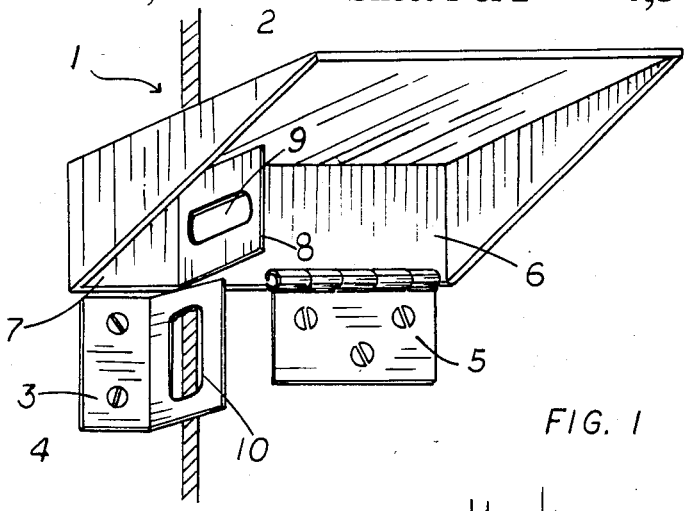
FIG. 1 is a perspective view showing a first embodiment of a security cover according to the invention in an open position.
Figure 2:
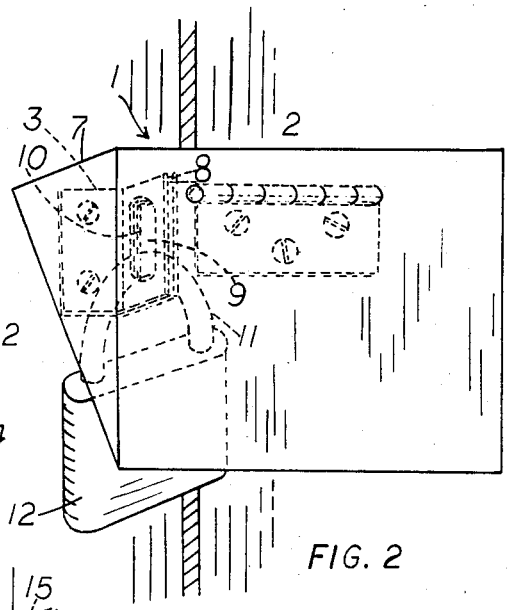
FIG. 2 shows the security cover of FIG. 1 in its closed position covering a padlock.

FIGS. 1 and 2 show a first embodiment of a security cover according to the invention. In this embodiment the cover itself forms the hasp part of a door lock.

In FIG. 1 the hasp or security cover 1 is shown secured to a door 2 with the staple 3 secured to the door frame 5, although clearly these devices could be arranged the opposite way round, i.e. the hasp or cover secured to the frame and the staple secured to the door.

The security cover 1 comprises a first part 5 comprising a flat plate bolted to the door 2, and a second part 6 hinged to the first part so as to be pivotable downwardly between the open position shown in FIG. 1 and the closed shown in FIG. 2 where it covers the staple 3.

The second part basically comprises a wedge-shaped cover with its back face 7 hinged at one end to the first part 5 and having an eye member 8 mounted at the other end. The eye member 8 is positioned so that when the cover is pivoted down into the position shown in FIG. 2, the eyes 9, 10 in the member 8 and the staple 3 are aligned. Thus different designs are possible for different types of door locks.

In the position shown in FIG. 2, the second or cover part 6 of the security cover can be locked in place by passing the shackle 11 of a padlock 12 through the aligned eyes 9, 10 as shown. Thus the cover forms part of the lock as well as acting as a security cover to protect the padlock shackle from tampering.

The cover protects at least the shackle part of the padlock, although the lower part of the padlock may project below the cover as shown to allow it to be opened with a key. There is a sufficient opening at the side between the cover and the door frame to allow a person to remove or insert the padlock when unlocked, but this opening is small enough to prevent insertion and operation of a cutting tool to cut through the shackle.

The security cover may be made of any suitable heavy duty metal sufficiently resistant to cutting open, such as heavy guage iron or steel.

Figure 3:
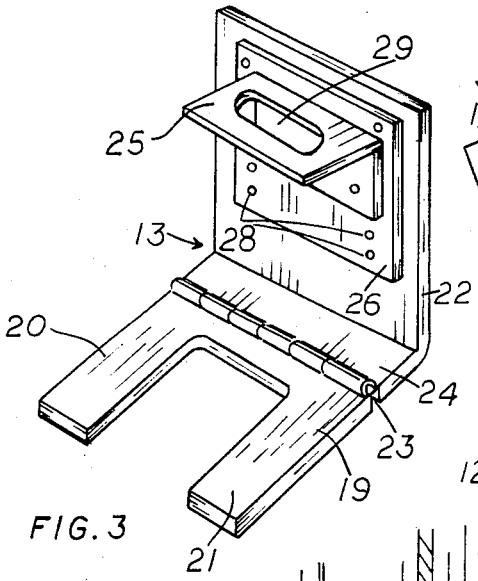
FIG. 3 is a perspective view of a second embodiment of a security cover according to the invention in an open position.
Figure 4:
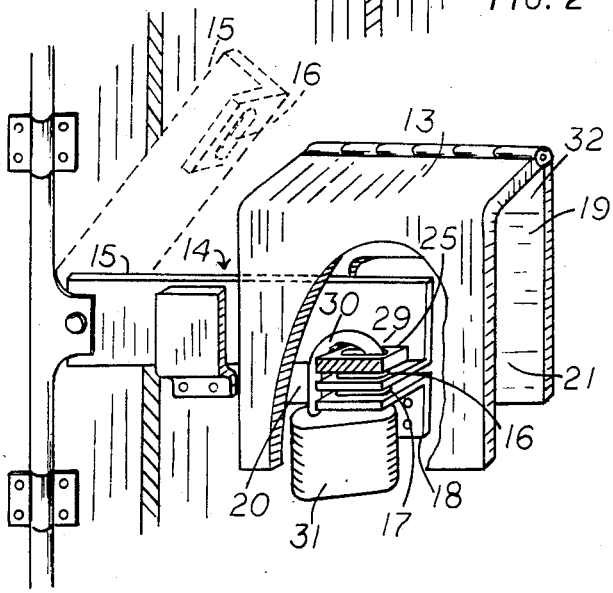
FIG. 4 shows the security cover of FIG. 3 in its closed position, partially broken away, covering a padlock securing a hasp to a staple.

FIGS. 3 and 4 show a second embodiment of the invention where the security cover 13 is completely different from the door locking device 14. In this embodiment a door locking device of the type used for securing van doors is shown, comprising a hasp 15 having an eye 16 rotatable into a position in which the eye 16 is aligned with an eye 17 on a staple 18 fixed to the opposite part of the door assembly to the hasp. Clearly the security cover could be designed for use with other types of locking devices secured by padlocks, for example of the sliding bolt type or the type where an eye passes through a slot or recess in the hasp or bolt to be engaged by a padlock.

The security cover 13 of this embodiment is shown in its open position in FIG. 3. The cover 13 comprises a first part 19 comprising a plate member having spaced legs 20, 21 for straddling part of a door lock, and a second part 22 hinged at 23 to the first part. The second part 22 comprises a generally L-shaped plate member, with the shortest part 24 of the member hinged to the first part 19 of the cover. An eye member 25 is adjustably mounted on a plate 26 secured to the inner face 27 of the second part 22 as seen in FIG. 1. The plate 26 has a series of bolt 28 allowing the eye member 25 to be secured in a variety of different locations, either horizontally as shown in FIG. 1 or vertically. Accordingly a single security cover 13 may be equipped with a variety of eye members 25 of different shapes and orientations in order to accomodate a large number of locking device configurations.

FIG. 4 shows the security cover in position covering a door lock. The cover 13 is partially broken away to reveal the padlock and aligned eyes of the door lock and security device.

In FIG. 4 the first part 19 of the security cover has been slipped behind the hasp 15 with its legs 20, 21 straddling the staple 18. This secures the cover in position. The second part 22 is then pivoted downwards over the door lock until the eye 29 in eye member 25 is aligned with the eyes 16, 17 in the hasp 15 and staple 18, respectively, as shown in FIG. 4. In this position the shackle 30 of padlock 31 can be passed through the aligned eyes so as to both lock the door and secure the cover 13 in place.

Clearly the position of the eye member 25 on the cover can be adjusted and arranged to be suitably aligned with all types of padlock-secured locking devices.

In the closed position of the cover shown in FIG. 4 the side opening 32 between the opposed faces of the first and second parts 19, 22 of the cover is sufficient to allow the padlock shackle to be looped through the aligned eyes or removed when unlocked, but insufficient to allow cutting tools such as bolt cutters to be used to cut through the padlock shackle.

Figure 5:
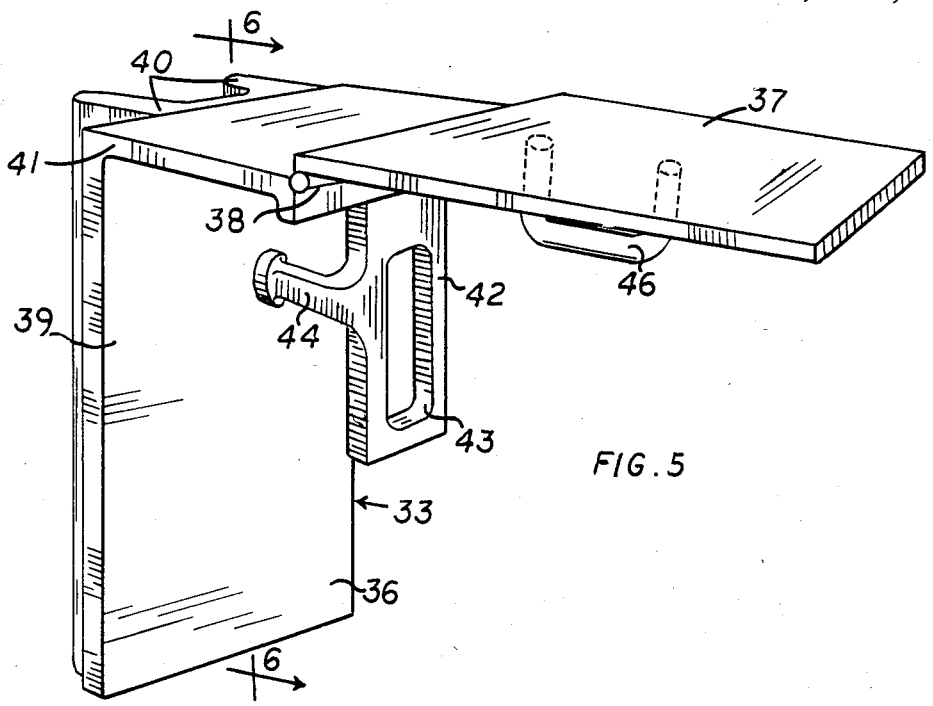
FIG. 5 shows a third embodiment of a security cover according to the invention in an open position.
Figure 6:
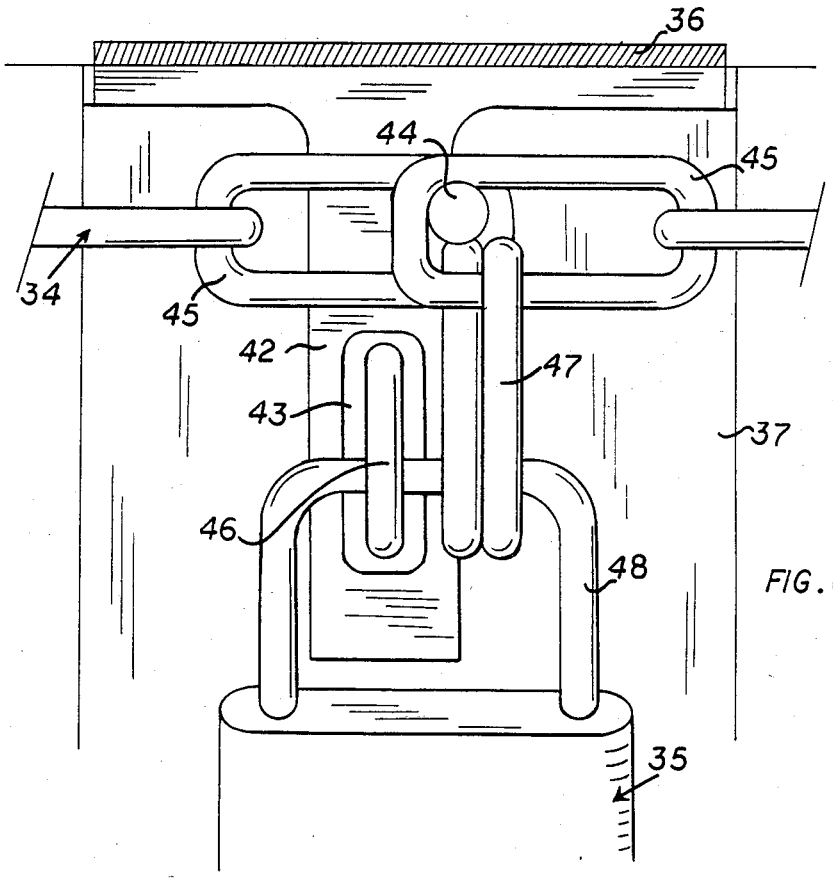
FIG. 6 is a view on the lines 6—6 of FIG. 5 showing the interior of the cover in a locked position.

FIGS. 5 and 6 show another embodiment of the invention where the security cover 33 is used to protect a chain 34 and padlock 35 securing a gate.

The security cover 33 of this embodiment comprises a first part 36 which can be located against a bar of a gate, and a second part 37 hinged at 38 to the first part so as to move between the open position shown in FIG. 5 and a closed, substantially vertical position as shown in FIG. 6.

The first part 36 comprises an L-shaped plate member, the longest part 39 of the L having ribs 40 on its rear face between which a bar of a gate can be located to retain the cover in position. The shorter part 41 of the L has a flange 42 having an eye or opening 43 projecting downwardly from it. A post 44 for locating links 45 of a chain projects inwardly from the eye member towards the rear face of the cover.

The second part 37 is a flat plate member having an eye 46 projecting inwardly from it which is arranged to project through the eye 43 of flange 42 when the cover is closed, as shown in FIG. 6. In this position the links 45 at opposite end areas of a chain 34 securing a gate can be located on the post 44 so that adjacent links 47 hang downwardly as shown. The padlock shackle 48 is then passed through the eye 46 and aligned links 47 from opposite ends of the chain. Thus the padlock 35 secures the gate and the cover 33 closed. The opposite parts 36 and 37 of the security cover shield the padlock shackle 48 against easy tampering, but can be released relatively easily when the gate is to be opened by someone with a key.

The security cover in each of the above enbodiments is of suitable strength material to resist cutting with normal tools, and may, for example, be of heavy guage iron or steel.

Thus the security cover in the embodiments described above will resist tampering with the padlock with tools such as bolt cutters and makes it more difficult for a burglar to break into a lock. The padlock could still be picked, but this would be awkward in view of the shielding of the cover preventing access from the side, and would take significantly longer. Thus the cover provides a significant deterrent to prospective burglars. The cover of the first two embodiments is particularly useful on trucks or vans to deter opportunistic types of thefts.

While the invention has been particularly shown and described with reference to the preferred embodiments, it will be understood that modifications can be made to the disclosed embodiments without departing from the scope of the invention, which is defined in the appended claims.

What is claimed is:

1. In cooperation with a padlock having a shackle engaging at least one eye of a lock or link of a chain for securing a door, gate or the like, a cover comprising:

a first plate shaped and dimensioned for mounting against the door, or gate;

a second plate hinged to the forward edge of the first plate for pivoting between an open position and a closed position generally parallel to and distal from said first plate and covering at least the shackle of the padlock;

said second plate including an eye member projecting from its inner face proximally to said eye or link in said closed position for locking engagement with said padlock shackle.

2. The security cover as claimed in claim 1 which further comprises means for adjusting the position of said eye member on said inner face.

3. The security cover as claimed in claim 1, wherein said first plate is secured rigidly to a door or frame part of the door; and said eye member projects proximally to said eye and is secured to the opposite part of the door in said closed position.

4. The security cover of claim 1 for association with a door lock of the type comprising a fixed member having said eye and a second member rotatably moveable into a position co-operating with said first member for locking engagement by the padlock, wherein said first plate is shaped and dimensioned for engagement behind said second member on opposite sides of said first fixed member, said second plate is L-shaped for covering said door lock and at least the shackle part of said padlock in the closed position, and said eye member is mounted on the inner face of the longer leg of said L-shaped plate and positioned for alignment with said eye in said closed position.

5. The security cover as claimed in claim 1, wherein said eye member is adjustably mounted on said second plate.

6. The security cover as claimed in claim 1 for association with a gate lock comprising the locking together of opposite links of a chain with the padlock, said first plate and second plate having locking means for engagement in said closed position, said locking means including means for locking engagement by said padlock shackle to lock said chain and security cover closed.

7. The security cover as claimed in claim 6 wherein said locking means comprise the eye member on said second plate passing through a loop member integral with said first plate.

8. The security cover as claimed in claim 7 which further comprises a post associated with said first plate and placed and dimensioned for engagement with links of said chain respectively adjacent to said opposite links.

* * * * *